United States Patent [19]

Pacheco

[11] Patent Number: 4,794,683

[45] Date of Patent: Jan. 3, 1989

[54] CAM SHAFT MANIPULATING TOOL

[76] Inventor: Orlando D. Pacheco, 2884 Trades W. Rd., Santa Fe, N. Mex. 87501

[21] Appl. No.: 103,539

[22] Filed: Oct. 1, 1987

[51] Int. Cl.[4] ..... B25B 27/14

[52] U.S. Cl. ..... 29/278; 81/488

[58] Field of Search ..... 29/278, 280, 282, 283, 29/281.1, 271; 81/488

[56] References Cited

U.S. PATENT DOCUMENTS

| | | | |
|---|---|---|---|
| 2,716,274 | 8/1955 | Smith . | |
| 2,860,535 | 11/1958 | Fowler . | |
| 3,003,230 | 10/1961 | Fornes . | |
| 3,108,365 | 10/1963 | DunVerley . | |
| 3,268,995 | 8/1966 | Pullin . | |
| 3,945,104 | 3/1976 | Brookover, Jr. | 29/282 |
| 4,283,827 | 8/1981 | Abel . | |

*Primary Examiner*—John K. Corbin
*Assistant Examiner*—J. Ryan
*Attorney, Agent, or Firm*—James E. Snead

[57] ABSTRACT

A cam shaft manipulating tool for removing and installing a cam shaft within the block of an internal combustion engine. The tool has a shaft threaded at one end for receiving a flange thereon, and a handle is mounted at the opposed end of the tool shaft. The flange is adjustably positioned respective to the tool shaft and to the face of the cam shaft so that part of the threaded end of the tool shaft extends through the flange and beyond the face of the flange that is opposed to the handle. An adaptor is threadedly received on the threaded end of the tool shaft. The adaptor slidably engages a central passageway found in the prior art cam shaft. A bolt circle formed in the flange is used to removably fasten one end of the tool to the end of a cam shaft. The tool enables the cam shaft to be removed and replaced into an engine block within inadvertently contaminating or injuring the cam shaft.

15 Claims, 2 Drawing Sheets

CAM SHAFT MANIPULATING TOOL

BACKGROUND OF THE INVENTION

A cam shaft is a critical component of any internal combustion engine and it must be in proper operating condition in order for the internal combustion engine to function properly. This is especially so in the instance of a high rpm supercharged engine where great expense and must study and effort is spent on the cam design. In the modern high performance engine, great care is taken with the finish imparted into the surface of the cam lobes and cam bearings of the cam shaft.

After the cam shaft bearings in the engine block have been carefully measured and fitted, and after the cam shaft surfaces have been precisely machined and polished, it is desirable that the cam shaft be precisely mounted within its bearings without damaging either the bearings or the cam surface. It is also desirable that the cam shaft be maintained surgically clean during the assembly. This usually cannot be accomplished by the direct use of one's hands for manipulating the cam shaft because invariably, towards the end of the installation, one of the cam shaft lobes will contact and mar the finish of one of the cam shaft bearings, or vice versa. Moreover, during the assembly one invariably will contaminate his hands and transfer the debris from the hands onto the cam shaft surface.

Accordingly, it would be desirable to have made available a cam shaft manipulating tool for holding, supporting, removing, and installing a cam shaft in an engine block in a manner which precludes the occurrence of the above undesirable drawbacks and which safely and hygenically enables installation of the cam shaft within the cam shaft bearings in a new and unexpected manner. A tool which achieves these desirable attributes is the subject of the present invention.

SUMMARY OF THE INVENTION

A tool which can be releasably attached to the end of a prior art cam shaft. The tool, when attached to a cam shaft, enables remote manipulation of the cam shaft in a positive manner. This enables a cam shaft to be removed and installed in an engine block without damaging the cam shaft or the cam shaft bearings. The tool also avoids contamination of the surface of the cam shaft and the cam shaft bearings.

The tool of this invention has an elongated centrally located shaft, one end of which is received within a bushed handle, and the other end of which is received through the axis of a special flange.

The flange has an outer face formed thereon for abuttingly engaging the outer face of a cam shaft that may be supported thereon, while the center of the cam shaft is threadedly engaged by an adaptor of the tool.

The adaptor threadedly mates with the outer marginal terminal end of the tool shaft, and bears against the flange face to thereby secure the flange against rotation while at the same time providing for support of a cam shaft. The external surface of the adaptor threadedly engages a cam shaft that may be supported thereon and thereby causes the confronting faces between the flange and cam shaft to abuttingly engage one another. This action provides a superior attachment means by which the cam shaft can be releasably attached to the tool and safely manipulated by the tool in a new and unobvious manner.

The bushed handle of the tool provides reinforcement within the handle by which bending forces are safely transmitted from a person's hands, through the tool, and to the cam shaft as the cam shaft is manipulated only by the outermost part thereof.

A primary object of the present invention is the provision of a cam shaft manipulating tool that engages only the outermost part of the cam shaft.

Another object of the invention is to provide a tool for installing and removing a cam shaft from an engine block.

A further object of this invention is to provide a tool for installing and removing a cam shaft from an engine block without contaminating or injuring the cam shaft and cam shaft bearings.

Another and still further object of this invention is the provision of a cam shaft manipulating tool that can be fitted to the end of a number of different prior art cam shafts, so that the cam shaft can be removed and installed in an engine block.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figure 1:
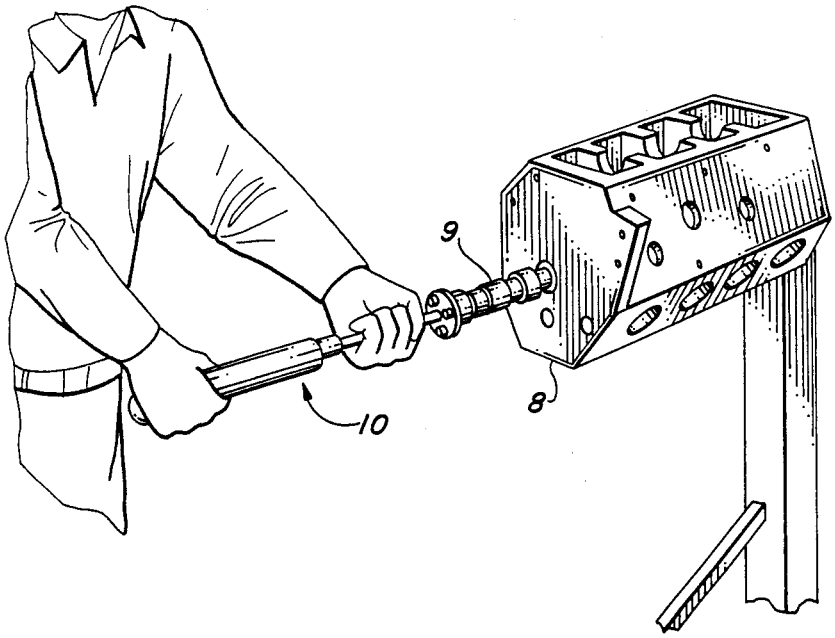
FIG. 1 is a fragmented, perspective view showing the present invention in operative relationship with an engine cam shaft.

In FIG. 1, there is disclosed a prior art internal combustion engine block 8 having a cam shaft 9 that is being manipulated by a cam shaft manipulating tool 10 made in accordance with the present invention. The tool 10 is removably affixed in attached relationship to the near end of the cam shaft 9 so that the cam shaft can be manipulated, and moved into proper operative relationship respective to the engine block 8.

Figure 2:
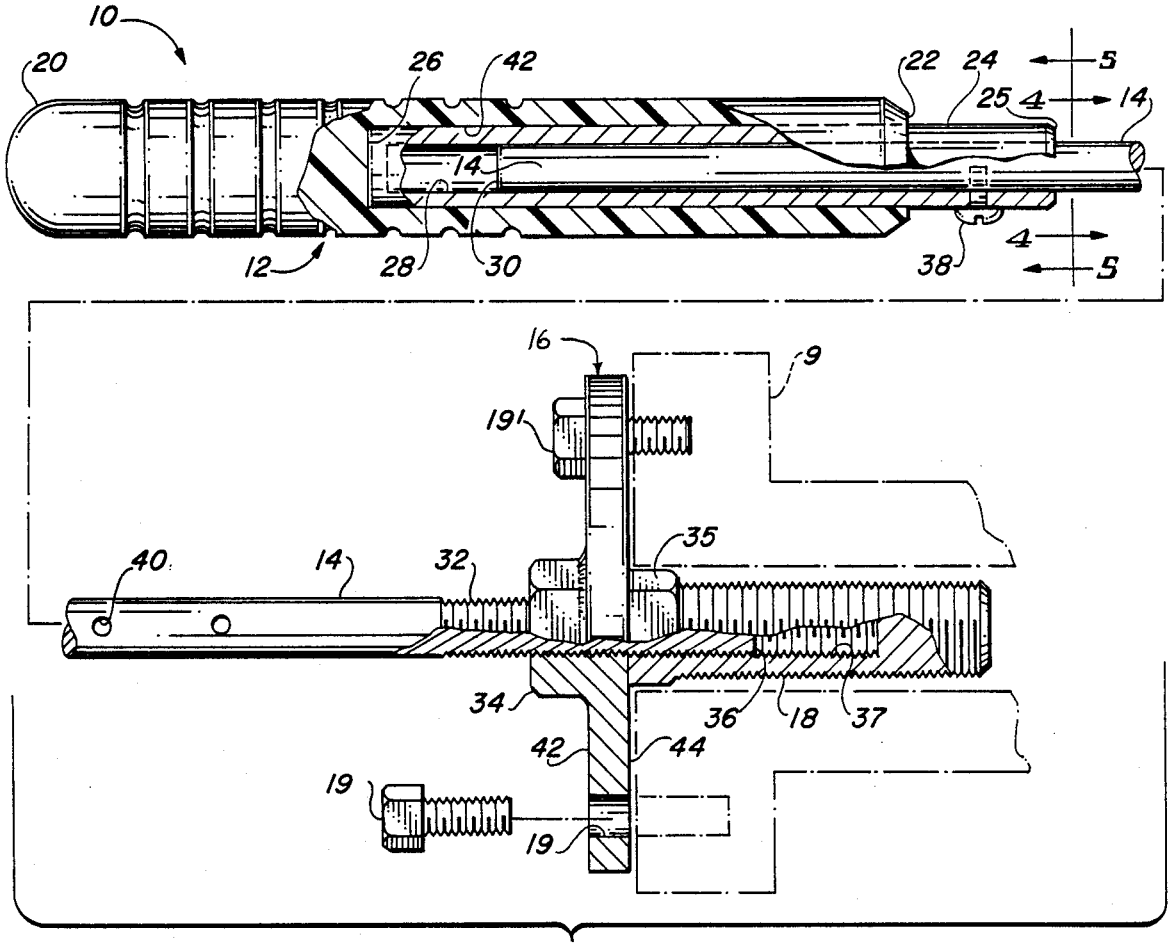
FIG. 2 is an enlarged, part longitudinal, part cross-sectional, part elevational view of the apparatus of the present invention.
Figure 3:
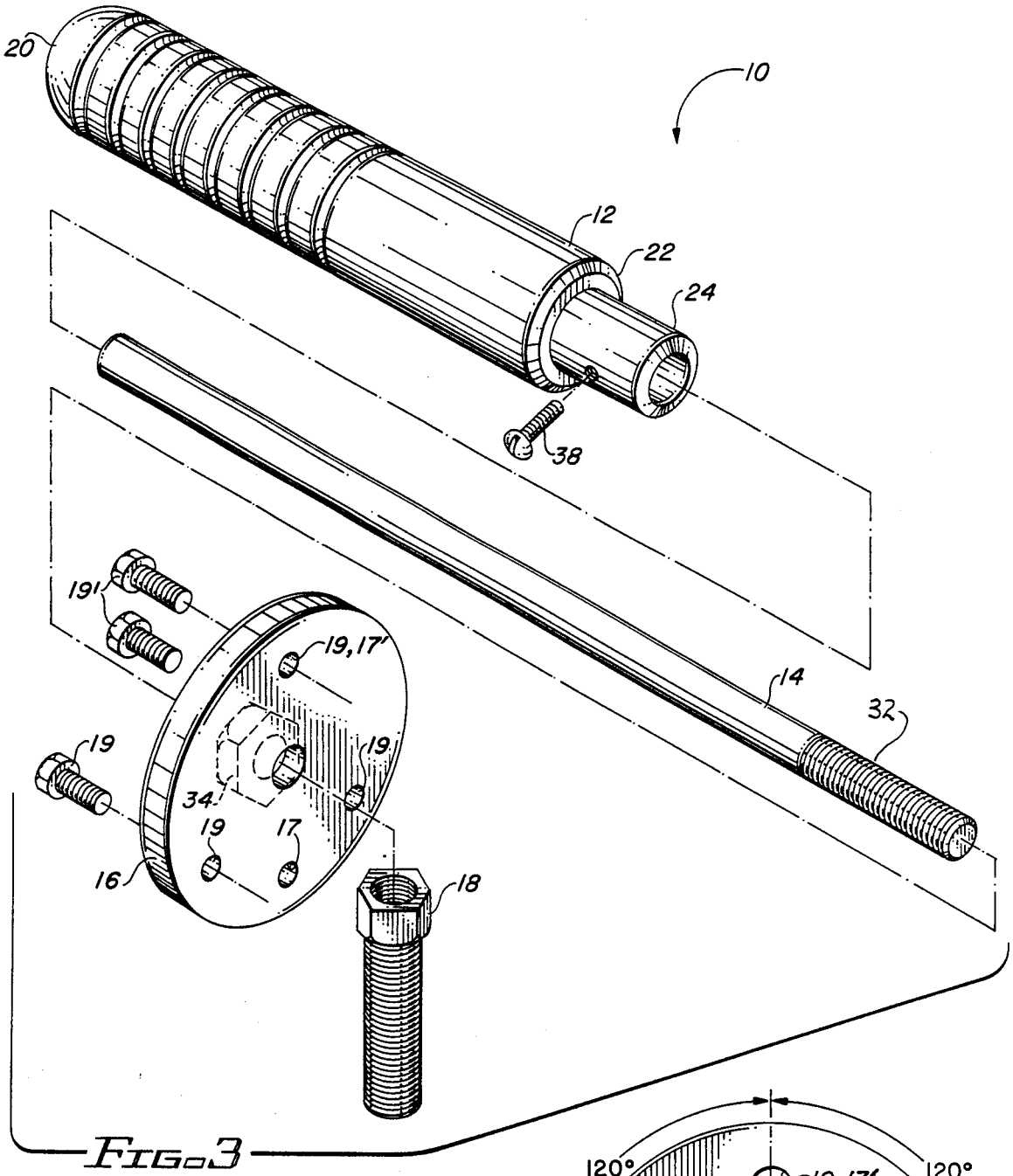
FIG. 3 is an exploded view of the apparatus disclosed in FIGS. 1 and 2; and, FIGS. 4 and 5 are cross-sectional views taken along line 4—4 and line 5—5 of FIG. 2.
Figure 5:
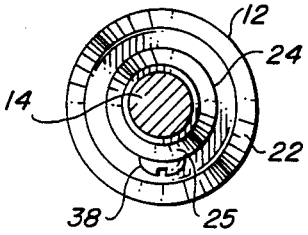

FIGS. 2–5 set forth the details of the tool 10. As seen in FIG. 2, together with other figures of the drawings, the tool 10 has a relatively large handle 12, preferably of a length that enables both hands of a mechanic to be placed thereon if desired. An extensible centrally located shaft 14 has one marginal end which is slidably received within handle 12. The other end of the shaft 14 has a flange 16 threadedly received thereon.

Figure 4:
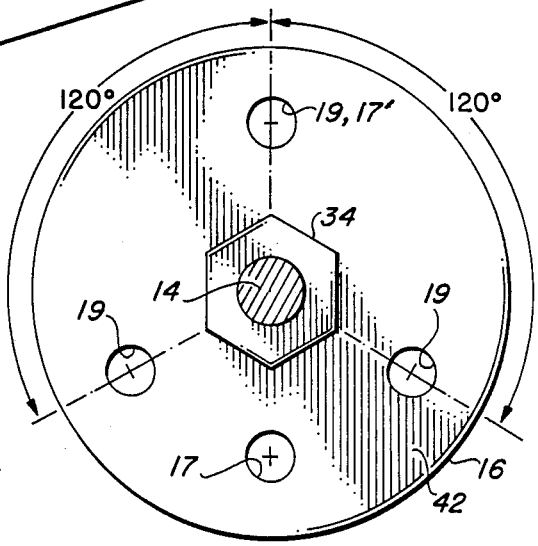

As seen in FIG. 4, together with other figures of the drawings, the flange 16 has threaded apertures 17, 19 perpendicularly arranged therein for threadedly receiving bolts 19' therethrough. The handle 12 can be made of any number of different materials such as metal, wood, or plastic, for example. In FIGS. 2–5, the handle 12 has opposed ends 20, 22 with there being a bushing 25 anchored within the interior of the handle 12. As particularly seen in FIG. 2, most of the marginal end 26 of the busing 25 is affixed within the counterbore that is formed within the interior of the handle. The bushing 24 has an axial passageway 28 which telescopingly receives a generous length of shaft 14 therein in close tolerance and slidable relationship therewith. One end 30 of the shaft 14 is received within bushing 24, while the opposed end 32 thereof is threaded and thereby threadedly mates with boss 34 of flange 16.

Adaptor 18 includes a boss 35, and is internally threaded at 37. The adaptor is removably affixed to the marginal end 36 of the shaft 14 that extends beyond the flange face 44. The exterior of the adaptor 18 is made into a configuration which admits it to be threadedly received within the cam shaft 9 of FIG. 1.

There are, of course, several adaptors 18, each having identical internal threads 37 for mating with threads 32 of shaft 14, but each having external threads for mating with various different style cam shafts. Moreover, bolt holes 19 are placed 120° apart and are configured to be mated with the end of some known cam shafts. Further, bolt circle 17, 17′ receives a bolt 19, 19′ therethrough and is arranged 180° apart for mating with other known cam shafts.

Accordingly, the cam shaft manipulating tool of the present invention has a flange 16 thereon which is provided with various different bolt hole patterns 17, 19 for engaging the end of a cam shaft; and, is further provided with an adaptor 18 which can threadedly mate with a threaded passageway formed in the end of other cam shafts.

A set screw 38 cooperates with the sleeve 24 and shaft 14 for adjusting the apparent length of shaft 14. Apertures 40 formed through shaft 14 receive the threaded end of screw 38 therethrough. The handle 12 is provided with counterbore 42 within which the sleeve 24 is cemented or otherwise rigidly affixed respective to the handle.

IN OPERATION

The length of the cam shaft manipulating tool of this invention is selected by loosening screw 38 and sliding end 30 of the shaft respective to end 26 of the sleeve 24 so that the flange 16 is spaced the desired distance from the end 25 of sleeve 24. Next, the type of fastener means by which the flange 16 is affixed to the end of cam 9 is selected. Where the cam shaft is internally threaded, the appropriate adaptor 18 is threadedly mated at 37 to the end 36 of the threaded portion 32 of shaft 14. Next, the adaptor is mated to the cam shaft by threadedly mating the external threads of the adaptor 18 with the internal threads found at the outer end of the cam shaft. The adaptor 18 preferably is screwed into the end of the cam shaft until the face 44 of flange 16 abuttingly engages the face of the cam shaft. The boss 35 will be received within the counterbore of the cam shaft when this has been accomplished.

Where the cam shaft has a bolt pattern about its outer face, rather than an internally threaded passageway, the appropriate bolts 19′ are selected and placed through the appropriate bolt patterns 17, 19 of the flange 16, thereby fastening face 44 of flange 16 to the outer face of the cam shaft by utilizing either two or three bolts as may be required in order to accommodate a specific geometrical configuration of cam shaft and the cam shaft manipulating tool 10.

The tool 10 of the present invention enables one to obtain adequate leverage between the two hands when the hands are placed on the wooden handle and shaft as seen in FIG. 1. This provides positive control over the cam shaft and enables one to carefully move the cam shaft axially through the multiplicity of cam shaft bearing passageways as the cam shaft is removed or replaced from the engine block. The cam shaft remains structurally sound and clean and free of debris when handled in this manner. The cam shaft can therefore be carefully guided respective to the engine block when it is held by the tool 10 in the manner of FIG. 1.

I claim:

1. A cam shaft manipulating tool for removing and installing a cam shaft within an engine block;

said tool has a centrally located longitudinally extending tool shaft, a handle affixed at one end of said tool shaft, a flange affixed at the other end of said tool shaft;

said flange has opposed faces with one face being directed towards the handle and the opposed face being directed towards a cam shaft that may be attached thereto;

an adaptor axially aligned with and attached to said tool shaft, and extending from the cam shaft face of said flange, said adaptor being removably received at the cam shaft face of the flange; said adaptor has an externally threaded surface for threadedly mating with a counterbore of a cam shaft;

said flange has a plurality of apertures through which a bolt can be extended into attached relationship respective to the end face of a cam shaft.

2. The cam shaft manipulating tool set forth in claim 1 wherein said handle has a counterbore, a hollow bushing is received within the handle counterbore, a marginal length of said bushing extends from said handle, said tool shaft has a marginal end thereof slidably received in a telescoping manner within said bushing, and means for adjusting the length of said shaft that is received within said bushing.

3. The tool of claim 1 wherein said flange has a threaded aperture formed through the center thereof which threadedly receives the threaded marginal end of said tool shaft, whereby said flange can be adjustably positioned along the marginal terminal end of said tool shaft.

4. The tool of claim 1 wherein said flange is threadedly received by the threaded end of said tool shaft, with there being a threaded marginal end of the shaft extending through said flange and into threaded engagement with said adaptor whereby;

said adaptor releasably secures the flange to the tool shaft while at the same time said adaptor threadedly engages a cam shaft in a manner to cause the confronting faces of the flange and cam shaft to abuttingly engage one another.

5. The tool of claim 1 wherein the cam side of said flange bears against the end of said cam shaft while said adaptor threadedly engages a hole that may be in said cam shaft.

6. A tool for manipulating a cam shaft so that the cam shaft can be removed and installed in an engine block; said tool has an elongated tool shaft with a handle being formed at one end of the tool shaft and a cam shaft engaging flange being formed at the other end of the tool shaft;

said flange is threadedly received on said tool shaft with there being a threaded portion of the shaft extending beyond said flange;

and adaptor having a threaded counterbore, said adaptor is threadedly received by the threaded end of said tool shaft, whereby said adaptor can be threadedly engaged with a hole that may be found in a cam shaft, with the cam shaft face abuttingly engaging the flange face.

7. The tool of claim 6 wherein said handle has a counterbore, a hollow bushing is received within the handle counterbore, a marginal length of said bushing extends from said handle, said tool shaft has a marginal end thereof slidably received in a telescoping manner within said bushing, and means for adjusting the length of said shaft that is received within said bushing.

8. The tool of claim 6 wherein said flange has a threaded aperture formed through the center thereof which threadedly receives the threaded marginal end of said tool shaft, whereby said flange can be adjustably positioned along the marginal terminal end of said tool shaft.

9. The tool of claim 6 wherein said flange is threadedly received by the end of said tool shaft, with there being a threaded marginal end of the shaft extending through said flange and into threaded engagement with said adaptor whereby;

said adaptor releasably secures the flange to the tool shaft while at the same time said adaptor threadedly engages a cam shaft in a manner to cause the confronting faces of the flange and cam shaft to abuttingly engage one another.

10. The tool of claim 6 wherein the cam side of said flange bears against the end of said cam shaft while said adaptor threadedly engages a hole that may be in said cam shaft.

11. A cam shaft manipulating tool for attachment to a cam shaft having attachment means thereon so that said tool can remove and install a cam shaft within an engine block;

said tool has a centrally located longitudinally extending tool shaft, a handle having a central bore within which one end of said tool shaft is received; a flange is axially affixed at the other end of said tool shaft;

said flange has opposed faces, with one face being directed towards a cam shaft that may be attached thereto;

an adaptor device for attachment to a cam shaft, said adaptor device is axially aligned with and attached to said tool shaft, and extends from the cam shaft face of said flange, said adaptor being removably received at the cam shaft face of the flange; said adaptor has an externally threaded surface for threadedly mating with a counterbore of a cam shaft;

said flange has a plurality of apertures formed therein through which a fastener can be placed into attached relationship respective to the end of a cam shaft.

12. The cam shaft manipulating tool set forth in claim 11 wherein said handle has a counterbore, a hollow bushing is received within the handle counterbore, a marginal length of said bushing extends from said handle, said tool shaft has a marginal end thereof slidably received in a telescoping manner within said bushing, and means for adjusting the length of said shaft that is received within said bushing.

13. The tool of claim 11 wherein said flange has a threaded aperture formed through the center thereof which threadedly receives the threaded marginal end of said tool shaft, whereby said flange can be adjustably positioned along the marginal terminal end of said tool shaft.

14. The tool of claim 11 wherein said flange is threadedly received by the threaded end of said tool shaft, with there being a threaded marginal end of the shaft extending through said flange and into threaded engagement with said adaptor whereby;

said adaptor releasably secures the flange to the tool shaft while at the same time said adaptor threadedly engages a cam shaft in a manner to cause the confronting faces of the flange and cam shaft to abuttingly engage one another.

15. The tool of claim 11 wherein the cam side of said flange bears against the end of said cam shaft while said adaptor threadedly engages a hole that may be in said cam shaft.

* * * * *